US012195297B2

(12) United States Patent
Schelter et al.

(10) Patent No.: US 12,195,297 B2
(45) Date of Patent: Jan. 14, 2025

(54) METHOD FOR OPERATING A TEXTILE MACHINE PRODUCING CROSS-WOUND PACKAGES, AND A TEXTILE MACHINE PRODUCING CROSS-WOUND PACKAGES

(71) Applicant: Saurer Spinning Solutions Gmbh & Co. KG, Uebach-Palenberg (DE)

(72) Inventors: Detlef Schelter, Erkelenz (DE); Stephan Kaspers, Viersen (DE)

(73) Assignee: Saurer Spinning Solutions Gmbh & Co. KG, Übach-Palenberg (DE)

( * ) Notice: Subject to any disclaimer, the term of this patent is extended or adjusted under 35 U.S.C. 154(b) by 377 days.

(21) Appl. No.: 17/762,909

(22) PCT Filed: Sep. 22, 2020

(86) PCT No.: PCT/EP2020/076348
§ 371 (c)(1),
(2) Date: Mar. 23, 2022

(87) PCT Pub. No.: WO2021/058446
PCT Pub. Date: Apr. 1, 2021

(65) Prior Publication Data

US 2022/0348435 A1 Nov. 3, 2022

(30) Foreign Application Priority Data

Sep. 24, 2019 (DE) ..... 10 2019 125 672.0

(51) Int. Cl.
*B65H 54/26* (2006.01)
*B65H 67/04* (2006.01)
(Continued)

(52) U.S. Cl.
CPC ..... *B65H 54/26* (2013.01); *B65H 67/0405* (2013.01); *D01H 9/02* (2013.01); *D01H 9/04* (2013.01); *D01H 15/00* (2013.01)

(58) Field of Classification Search
CPC . D01H 9/02; D01H 9/04; D01H 15/00; B65H 54/26; B65H 63/00; B65H 67/04;
(Continued)

(56) References Cited

U.S. PATENT DOCUMENTS 3,645,084 A * 2/1972 Nimtz ..... D01H 1/241 57/88
3,789,595 A * 2/1974 Bernstein ..... D01H 13/32 57/264
(Continued)

FOREIGN PATENT DOCUMENTS

DE 10139075 A1 2/2003
DE 102006047288 A1 4/2008
(Continued)

OTHER PUBLICATIONS

International Search Report and Writen Opinion, PCT/EP2020/076348, dated Dec. 10, 2020, 4 pages.
(Continued)

*Primary Examiner* — Shaun R Hurley
(74) *Attorney, Agent, or Firm* — Nelson Mullins Riley & Scarborough LLP

(57) ABSTRACT

A method for operating a textile machine producing cross-wound packages has a multiplicity of autonomous work stations that each have a spinning apparatus and a winding apparatus and are equipped with a suction nozzle, connected to the vacuum network of the textile machine, for receiving a thread from the surface of a cross-wound package, and also a storage nozzle, likewise connected to the vacuum network, for temporarily storing excess thread length, and which is operated at least by one service unit that exchanges full cross-wound packages for empty tubes as required. The invention provides for the actuation of a cross-wound package/empty tube exchange by one of the service units to be prevented during the operations of restarting of the work
(Continued)

stations, thereby ensuring that, during the restarting of the autonomous work stations, the maximum number of work stations always starts up again at the same time.

6 Claims, 2 Drawing Sheets

(51) Int. Cl.
*D01H 9/02* (2006.01)
*D01H 9/04* (2006.01)
*D01H 15/00* (2006.01)

(58) Field of Classification Search
CPC ..... B65H 67/0405; B65H 67/0411; B65H 67/0417; B65H 67/081
USPC ..... 57/261, 263, 264, 266, 276
See application file for complete search history.

(56) References Cited

U.S. PATENT DOCUMENTS 4,823,544 A * 4/1989 Igel ..... D01H 13/005 57/264
6,226,971 B1 * 5/2001 Stephan ..... B65H 54/26 57/263
10,351,976 B2 * 7/2019 Stephan ..... D01H 4/48
2019/0177884 A1 * 6/2019 Doerner ..... D01H 9/10
2019/0233980 A1 * 8/2019 Schloemer ..... D01H 4/50

FOREIGN PATENT DOCUMENTS

DE 102006050220 A1 4/2008
DE 102007053467 A1 5/2009
DE 102018102135 A1 8/2019
EP 3168179 A1 5/2017
EP 3533739 A1 9/2019

OTHER PUBLICATIONS

Search report, German Application No. 102019125672.0, dated Aug. 7, 2020, 5 pages.
Office Action, Bangladesh Application No. 269/2020/7248, dated Nov. 15, 2021, 1 page.

* cited by examiner

METHOD FOR OPERATING A TEXTILE MACHINE PRODUCING CROSS-WOUND PACKAGES, AND A TEXTILE MACHINE PRODUCING CROSS-WOUND PACKAGES

CROSS-REFERENCE TO RELATED APPLICATIONS

This application claims priority from PCT/EP2020/076348, filed Sep. 22, 2020, which claims priority to DE 10 2019 125 672.0, filed Sep. 24, 2019, entitled "Verfahren zum Betreiben einer Kreuzspulen herstellenden Textilmaschine and eine Kreuzspulen herstellende Textilmaschine", the entire contents of which are incorporated herein by reference.

FIELD OF THE INVENTION

The invention relates to a method for operating a textile machine producing cross-wound packages, which textile machine has a plurality of autonomous workstations, which each have a spinning device and a winding device and are equipped with a suction nozzle for receiving a thread from the surface of a cross-wound package, which suction nozzle is connected to the negative-pressure network of the textile machine, and with a storage nozzle for temporarily storing excess thread length, which storage nozzle is likewise connected to the negative-pressure network, the textile machine being served by at least one service unit, which doffs full cross-wound packages for empty tubes as needed. The invention also relates to a textile machine producing cross-wound packages.

BACKGROUND OF THE INVENTION

Textile machines that produce cross-wound packages, such as open-end rotor spinning machines or air-jet spinning machines, generally have a plurality of identical workstations arranged next to one another in a row, at each of which a thread is spun from a fibre band, which, for example, is supplied in a spinning can, the thread being subsequently wound into a cross-wound package. The workstations of such textile machines each have a plurality of different apparatuses for this purpose, such as a spinning device and a winding device, and it was common for a long time to act on the working elements of the workstations by means of driving elements that run the length of the machine.

The workstations of such textile machines are generally served by at least one service unit, which patrols along the workstations of the open-end rotor spinning machine and automatically intervenes when a need for action has arisen at one of the workstations, for example as a result of a thread break. In such a case, the service unit runs to the workstation in question, locks itself there and searches, by means of a pivotably mounted suction nozzle to which negative pressure can be applied, for the thread end of the torn thread, the torn thread having run onto the cross-wound package after the thread break.

It is also known that a plurality of these services units can be used simultaneously on an open-end rotor spinning machine so that, in the event of malfunctions, individual workstations do not have to wait too long for a service unit because the service unit is still working on eliminating a thread break at another workstation.

However, these known open-end rotor spinning machines have the disadvantage that, after technical problems, e.g. voltage drops in the power grid, which are not at all rare, especially in developing countries, it takes a relatively long time until all the workstations of the open-end rotor spinning machine have been gradually pieced up again by the service units after such a shutdown, i.e. after a complete shutdown of the machine.

Therefore, open-end rotor spinning machines having workstations that operate largely autonomously, as described for example in German Patent Publication DE 101 39 075 A1, have already been developed in the past. That is, the workstations of such open-end rotor spinning machines are not only each equipped with an open-end spinning device and a winding device, as usual, but additionally each have a pivotably mounted suction nozzle to which negative pressure can be applied, and a storage nozzle, to which negative pressure can likewise be applied.

The pivotably mounted suction nozzle can be moved in a defined manner between a thread-end receiving position in the region of the surface of the cross-wound package and a thread-end transfer position in the region of the open-end rotor spinning device by means of an electric-motor drive, while the stationary storage nozzle temporarily receives the excess thread that arises during the running up of the workstation.

In these known autonomous workstations, the suction nozzle and the storage nozzle are connected to a duct, running the length of the machine, of the negative-pressure network of the textile machine by means of a connection line and can be jointly subjected to negative pressure via a valve or a slider.

Because in case of need such autonomous workstations do not have to first wait for one of the service units after a thread break, as is usual in the case of "normal" open-end rotor spinning machines, but rather can be immediately autonomously pieced up again after thread breaks or controlled clearer cuts, open-end rotor spinning machines equipped with such autonomous workstations are characterised by relatively high efficiency.

An additional advantage of such open-end rotor spinning machines equipped with autonomous workstations is that a plurality of workstations can be simultaneously pieced up again after technical problems, for example after voltage drops in the power grid, in the event of which generally all the workstations of the textile machine come to a standstill at the same time. The number of workstations that can be simultaneously pieced up again is limited to a certain number of workstations, determined by the storage nozzle to which negative pressure can be applied and by the suction nozzle, to which negative pressure can likewise be applied, which each have relatively high suction air consumption.

Therefore, in order to increase the number of autonomous workstations that can be simultaneously pieced up again after a technical problem, it has already been proposed that the suction nozzle and the storage nozzle of each workstation are connected to the negative-pressure network of the textile machine by means of a double valve or two individual valves in such a way that the suction nozzle and the storage nozzle can be actuated in a defined manner, including individually, when required.

In such autonomous workstations, which are known from German Patent Publication DE 10 2006 047 288 A1 for example, the suction nozzle and the storage nozzle are connected to the negative-pressure network independently of one another by means of separate connection lines. A closing means is connected in each of the connection lines and allows the suction nozzle or the storage nozzle to be pneumatically connected to the negative-pressure network or to be uncoupled from the negative-pressure network when the element in question is no longer needed in the course of the piecing process. That is, the suction nozzles and the storage nozzles, which are relatively large negative-pressure consumers, are connected to the negative-pressure network of the textile machine precisely only as long as they absolutely need negative pressure.

Autonomous workstations having the design described in German Patent Publication DE 10 2006 047 288 A1 have a significantly lower negative-pressure demand during a piecing process in comparison with autonomous workstations according to German Patent Publication DE 101 39 075 A1, and therefore it was possible to approximately double the number of workstations that could be simultaneously pieced up again after a technical problem.

However, this relatively high number of workstations that can be simultaneously pieced up again drops again when the service units perform cross-wound package/empty-tube doffing during the piecing operations of the workstations.

SUMMARY OF THE INVENTION

Proceeding from the prior art mentioned above, the problem addressed by the invention is that of developing a method by means of which the operation of open-end rotor spinning machines equipped with autonomous workstations is optimised, in particular the time period required to piece up all the workstations of the textile machine again is minimised. That is, the method according to the invention is aimed at ensuring that always the maximum number of autonomous workstations is simultaneously pieced up again after a shutdown of the textile machine.

This problem is solved according to the invention in that, in the piecing up of the autonomous workstations of the textile machine again after a technical problem that caused all the workstations of the textile machine to be switched off, the service units are prevented from performing cross-wound package/empty-tube doffing during the piecing operations, thus ensuring that always the maximum number of workstations is simultaneously pieced up again during the piecing up of the autonomous workstations.

The dependent claims relate to advantageous embodiments of the invention.

The method according to the invention has the advantage that, by temporarily blocking interventions of the service units, the method prevents a reduction in the suction air amount available in the negative-pressure network of the textile machine due to additional negative-pressure consumers during the piecing processes of the autonomous workstations. That is, it is ensured that, during the piecing up of the workstations of the open-end rotor spinning machine, always the entire suction air amount available in the negative-pressure network of the textile machine is available for the piecing processes of the workstations and therefore always the maximum number of workstations can be simultaneously pieced up again.

In an advantageous embodiment, the service units are prevented from performing cross-wound package/empty-tube doffing during the piecing up of the autonomous workstations of the textile that have come to a standstill, for example after a shutdown. That is, by temporarily suspending work orders to the service units, it is prevented that, during the piecing up of the workstations, additional negative-pressure demands arise again at workstations already pieced back up, because this would immediately lead to a lowering of the number of autonomous workstations that can be simultaneously pieced back up. That is, the time period needed to run the open-end rotor spinning machine back up to the normal operating state would become significantly longer.

The central control unit of the textile machine is preferably prevented from issuing work orders to one of the service units. Temporarily doing without interventions of the service units, as described above, prevents a drop in the number of autonomous workstations that can always be simultaneously pieced up again during the piecing process of the e.g. 500 to 600 workstations of the textile machine. That is, the number of workstations that constantly can be simultaneously pieced up again is prevented from dropping by, for example, two in comparison with the number of workstations that can be simultaneously pieced up again when the negative-pressure network is not strained by additional consumers.

The problem is also solved by means of a textile machine producing cross-wound packages, comprising a control unit for carrying out the method according to the invention. The central control unit, which is provided anyway, is preferably modified for this purpose. The central control unit is then preferably designed in such a way that it does not issue any work orders to one of the service units during the piecing-up operations of the workstations after a technical problem that resulted in all the workstations of the textile machine being switched off.

BRIEF DESCRIPTION OF THE DRAWINGS

The invention is explained in greater detail below on the basis of an embodiment example shown in the drawings.

In the figures.

DESCRIPTION OF THE PREFERRED EMBODIMENTS

Figure 1:
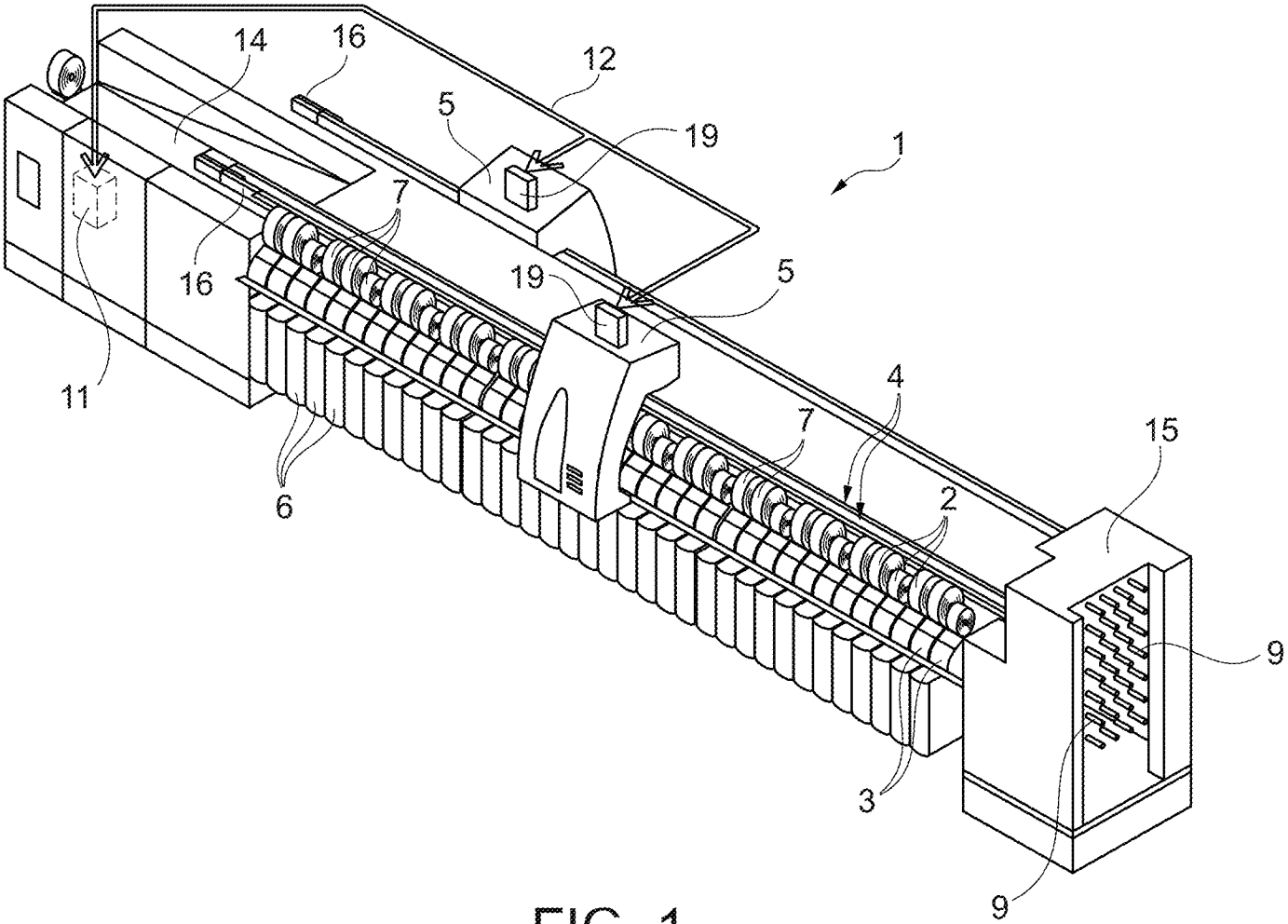
FIG. 1 is a perspective view of a textile machine producing cross-wound packages, in which the method according to the invention is used—in the embodiment example an open-end rotor spinning machine having autonomous workstations and two service units that can be used when required.

FIG. 1 is a perspective view of a textile machine producing cross-wound packages—in the embodiment example an open-end rotor spinning machine 1. The open-end rotor spinning machine 1 has a plurality of autonomous workstations 2, which are each equipped with, inter alia, a spinning device 3 and a winding device 4, as usual. The autonomous workstations 2 each additionally have, as explained in more detail below on the basis of FIG. 2, a suction nozzle 18, to which negative pressure can be applied and which can be controlled in a defined manner, and a storage nozzle 25, to which negative pressure can be applied and which can likewise be controlled in a defined manner.

The open-end rotor spinning machine 1 is also equipped with two or more identical service units 5, which, during normal operation, doff completed cross-wound packages 7 for empty tubes 9 and ensure that the workstations 2 are cyclically cleared.

As is known, a fibre band supplied in a spinning can 6 is spun into a thread in each of the spinning devices 3 of the workstations 2, the thread subsequently being wound into a cross-wound package 7 on one of the winding devices 4. For this purpose, the winding devices 4, as shown in FIG. 2, are each equipped with a package cradle 8 for rotatably holding an empty tube 9 or a cross-wound package 7 and with a winding drum 10 for rotating these elements.

The open-end rotor spinning machine 1 also has a central control unit 11, which is connected to the control apparatuses 19 of the service units 5 and to the control apparatuses 13 of the workstations 2 via a bus system 12. Moreover, such open-end rotor spinning machines 1 have a cross-wound package transport apparatus 14 for disposing of completed cross-wound packages 7, and an empty-tube supply apparatus, which substantially consists of an empty-tube magazine 15 and tube feed tracks 16.

As indicated, the service units 5 can be moved on guide rails arranged on the open-end rotor spinning machine 1 and, as is known, have various handling apparatuses (not shown), which allow the service units 5 to carry out cross-wound package/empty-tube doffing and to clear the workstations 2 as needed. That is, during the regular spinning operation the service units 5 automatically intervene if there is a need for action at one of the workstations 2 and this is signaled, for example, by a work order. Such a work order is issued if, for example, the cross-wound package 7 has reached its prescribed diameter at one the workstations 2 and has to be exchanged for an empty tube 9.

Figure 2:
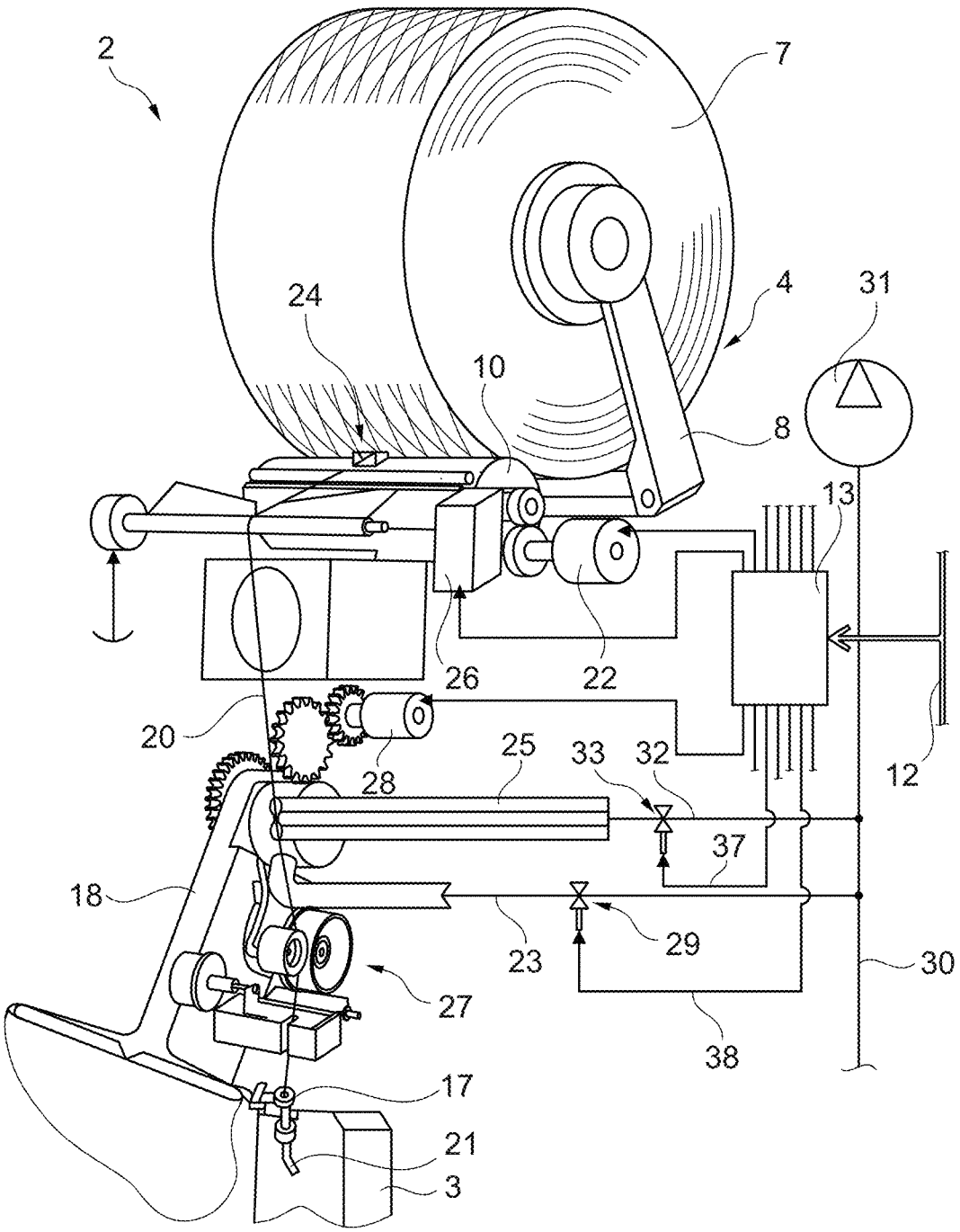
FIG. 2 is a perspective view of an autonomous workstation of the open-end rotor spinning machine shown in FIG. 1, the workstations each being equipped with a suction nozzle, to which negative pressure can be applied and which can be controlled in a defined manner, and with a storage nozzle, to which negative pressure can be applied and which can likewise be controlled in a defined manner.

FIG. 2 is a perspective view of one of the autonomous workstations 2 of an open-end rotor spinning machine 1 in which the method according to the invention is used when needed.

As is known and therefore only schematically illustrated, such workstations 2 are each equipped with a spinning device 3 and a winding device 4, a piecing tool 17 being arranged on the spinning device 3 in the region of what is referred to as a thread draw-off tube 21. After a thread break or a controlled clearer cut, the piecing tool 17 receives the thread 20 retrieved from the cross-wound package 7 by the suction nozzle 18, to which negative pressure has been applied, and prepares the thread end for the piecing up.

Furthermore, such autonomous workstations 2 are each equipped with a thread draw-off apparatus 27, which takes on the drawing of the thread 20 from the spinning device 3 during the regular spinning operation and also ensures that a prepared thread 20 is fed back into the spinning device 3 in a defined manner during piecing.

As usual, the winding device 4 has a package cradle 8 for rotatably holding a cross-wound package 7, a winding drum 10, which preferably can be acted upon by a reversible individual drive 22, and a thread traversing apparatus 24, which is driven, for example, by means of a stepper motor 26.

Furthermore, as already indicated above, such autonomous workstations 2 each have a pivotably mounted suction nozzle 18, to which negative pressure can be applied and which can be moved in a defined manner between a thread receiving position in the region of the winding device 4 and a thread transfer position in the region of the spinning device 3 by means of a stepper motor 28, and a storage nozzle 25, to which negative pressure can likewise be applied and which temporarily stores the arising excess thread length during the running up of the workstation 2 and, in doing so, ensures that the thread 20 produced in the spinning device 3 is wound with proper winding tension into a cross-wound package 7.

Both the storage nozzle 25 and the pivotably mounted suction nozzle 18 can be separately subjected to negative pressure in a defined manner.

In the embodiment shown, the suction nozzle 18 is connected to the textile machine's own negative-pressure network 30 by means of a connection line 23, and the storage nozzle 25 is connected thereto by means of a connection line 32, the negative-pressure source of said network being labelled with reference sign 31 in FIG. 2.

A closing means 29 controllable in a defined manner and a closing means 33, e.g. a valve or a slider apparatus, are connected in the connection line 23 and in the connection line 32, respectively. The closing means 29, 33, which are connected via control lines 37, 38, respectively, to the control apparatus 13 of the workstation 2 or to the central control unit 11 of the open-end rotor spinning machine 1, ensure that the suction nozzle 18 and the storage nozzle 25, respectively, are appropriately subjected to negative pressure or disconnected from the negative-pressure network 30 of the open-end rotor spinning machine 1.

Function of the method according to the invention:

If, during the spinning operation of an open-end rotor spinning machine 1 equipped with autonomous workstations 2, a large technical problem arises, for example a voltage drop in the power grid that powers the textile machine, all the workstations 2 of the open-end rotor spinning machine 1 simultaneously come to a standstill, resulting in thread breaks at all the workstations 2 of the open-end rotor spinning machine 1.

After the technical problem has been corrected, all the autonomous workstations 2 of the open-end rotor spinning machine 1 must be pieced up again in order to return the open-end rotor spinning machine 1 to its regular operating state. Because minimizing the time period needed to return all the workstations 2 of the open-end rotor spinning machine 1 to regular spinning operation has a positive effect on the efficiency of the open-end rotor spinning machine 1, advantageously the largest possible number of workstations 2 is pieced up again at the same time.

However, because the amount of negative pressure that can be provided at the same time by the negative-pressure network 30 of the open-end rotor spinning machine 1 is relatively limited, determined by the design of the negative-pressure network 30, in particular by the cross-section of the negative-pressure duct running the length of the machine, it is advantageous in this regard if the suction air demand of the individual workstations is minimized during the run-up operations and if it is ensured that no other additional suction air consumptions occur during the run-up process of the open-end rotor spinning machine 1.

Additional suction air consumption of this kind would occur if, for example, a cross-wound package 7 has reached its specified diameter at one of the workstations 2 already pieced up and is exchanged for an empty tube 9. In the event of such cross-wound package/empty-tube doffing to be initiated by one of the service units 5, the negative-pressure consumers, especially the suction nozzle 18 and the storage nozzle 25 of the workstation 2 in question, would be active at the same time, and as a result the required suction air amount would increase and thus the level of the negative pressure in the negative-pressure network 30 would drop somewhat.

In relation to autonomous workstations 2, which, as described in German Patent Publication DE 10 2006 047 288 A1, each have a suction nozzle 18 and a storage nozzle 25 that can be specifically switched on or off, the present invention made it possible to reduce the suction air demand of the workstations 2 during the piecing operation to such an extent that it was possible to significantly increase the number of workstations 2 that can be simultaneously pieced up again after a technical problem.

However, in order to be able to always ensure this relatively large number of e.g. 24 workstations 2, it must be ensured that the negative-pressure network 30 is not strained by other additional suction air consumers during the piecing process of the workstations 2, as already mentioned above.

For this reason, in the method according to the invention, which is used in particular in the piecing up of an open-end rotor spinning machine 1 producing cross-wound packages after a technical problem that caused all the workstations 2 of the open-end rotor spinning machine 1 to come to a standstill, a service unit 5 that would activate an additional suction air consumer is prevented from becoming active during the simultaneous piecing operations of the autonomous workstations 2. That is, according to the method according to the invention it is ensured that the central control unit 11 of the open-end rotor spinning machine 1 does not send any work orders to one of the service units 5, even if there is a need at a workstation 2. Such work orders are not issued again until all of the e.g. 500 to 600 workstations 2 of the open-end rotor spinning machine 1 have been pieced up again.

LIST OF REFERENCE SIGNS

1 Open-end rotor spinning machine
2 Workstation
3 Spinning device
4 Winding device
5 Service unit
6 Spinning can
7 Cross-wound package
8 Package cradle
9 Empty tube
10 Winding drum
11 Central control unit
12 Bus system
13 Control apparatus
14 Cross-wound package transport apparatus
15 Empty-tube magazine
16 Tube feed track
17 Piecing tool
18 Suction nozzle
19 Control apparatus
20 Thread
21 Thread draw-off tube
22 Individual drive
23 Connection line
24 Thread traversing apparatus
25 Storage nozzle
26 Stepper motor
27 Thread draw-off apparatus
28 Stepper motor
29 Closing means
30 Negative-pressure network
31 Negative-pressure source
32 Connection line
33 Closing means
37 Control line
38 Control line It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

The invention claimed is:

1. A method for operating a textile machine producing cross-wound packages and has a plurality of autonomous workstations, which each have a spinning device and a winding device and are equipped with a suction nozzle for receiving a thread from the surface of a cross-wound package, which suction nozzle is connected to a negative-pressure network of the textile machine, and with a storage nozzle for temporarily storing excess thread length, which storage nozzle is likewise connected to the negative-pressure network, the textile machine being served at least by one service unit, which doffs full cross-wound packages for empty tubes as needed, characterised in that, in the piecing up of the autonomous workstations of the textile machine again after a technical problem that caused all the workstations of the textile machine to be switched off, the service units are prevented from performing cross-wound package/empty-tube doffing during the piecing-up operations of the workstations, thus ensuring the maximum number of workstations is simultaneously pieced up again in the piecing up of the autonomous workstations.

2. The method for operating a textile machine producing cross-wound packages according to claim 1, characterised in that the service units are prevented from performing cross-wound package/empty-tube doffing during the piecing up of the autonomous workstations of the textile that have come to a standstill.

3. The method for operating a textile machine producing cross-wound packages according to claim 1, characterised in that a central control unit of the textile machine is prevented from issuing work orders to one of the service units.

4. The method for operating a textile machine producing cross-wound packages according to claim 1, characterised in that, by temporarily doing without interventions of the service units, the number of autonomous workstations that can be simultaneously pieced up again is prevented from dropping below the maximum number.

5. A textile machine producing cross-wound packages and has a plurality of autonomous workstations, which each have a spinning device and a winding device and are equipped with a suction nozzle for receiving a thread from the surface of a cross-wound package, which suction nozzle is connected to a negative-pressure network of the textile machine, and with a storage nozzle for temporarily storing excess thread length, which storage nozzle is likewise connected to the negative-pressure network, the textile machine being served at least by one service unit, which doffs full cross-wound packages for empty tubes as needed, characterised in that, the textile machine producing cross-wound packages comprises a control unit, which is designed to carry out the method according to claim 1.

6. The textile machine producing cross-wound packages according to claim 5, characterised in that the control unit is designed as a central control unit of the textile machine.

* * * * *